United States Patent [19]

Joy

[11] 4,145,947

[45] Mar. 27, 1979

[54] ELECTRO PNEUMATIC PLAYER PIANO

[76] Inventor: Luther S. Joy, 23733 Hynford, Harbor City, Calif. 90710

[21] Appl. No.: 465,305

[22] Filed: Apr. 29, 1974

[51] Int. Cl.[2] ..... G10F 1/02; G10F 1/12; G10F 5/06

[52] U.S. Cl. ..... 84/50; 84/60; 84/123; 84/125; 84/129

[58] Field of Search ..... 84/122, 123, 50–53, 84/55–57, 60–63, 67, 133

[56] References Cited

U.S. PATENT DOCUMENTS

| | | | |
|---|---|---|---|
| 814,677 | 3/1906 | Doman | 84/50 |
| 886,569 | 5/1908 | Wood | 84/60 |
| 1,053,936 | 2/1913 | Van Valkenburg | 84/62 |
| 1,246,096 | 11/1917 | Hiscock | 84/56 |
| 1,324,700 | 12/1919 | Spencer | 84/55 |
| 1,617,300 | 2/1927 | Gulbransen | 84/67 |
| 1,769,760 | 7/1930 | Stoddard | 84/133 |
| 1,788,561 | 1/1931 | Boettcher | 84/122 |
| 3,117,481 | 1/1964 | Cushing | 84/123 X |
| 3,472,110 | 10/1969 | Slatts et al. | 84/122 X |

*Primary Examiner*—Lawrence R. Franklin

[57] ABSTRACT

The specification discloses a pneumatic player piano which utilizes an electric motor roll drive. The roll drive is actuated by a mechanical switching arrangement which responds to the system vacuum so as to simulate the operation of a conventional air motor. The pneumatic stack is constructed to permit the pouch board and valve boxes of an entire level to be fabricated in a single molding operation. The valves themselves are formed of silicone rubber - and require neither backing, facing nor position adjustment.

3 Claims, 13 Drawing Figures

FIG. 1.
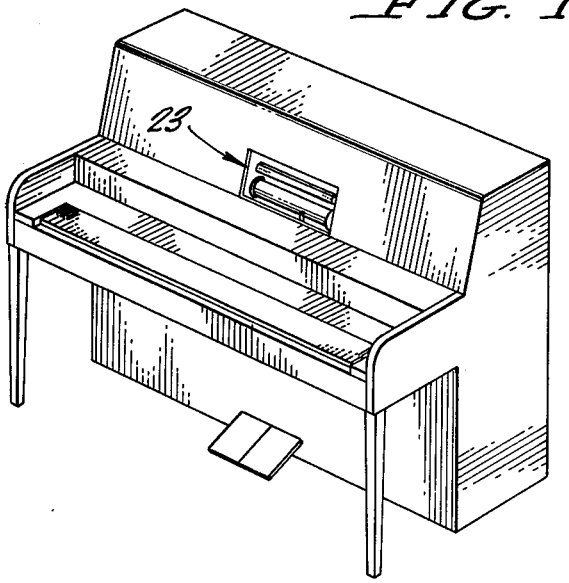
FIG. 12.
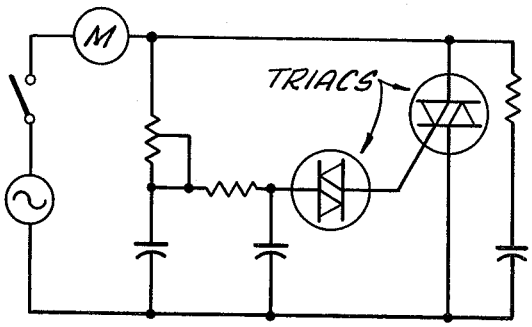
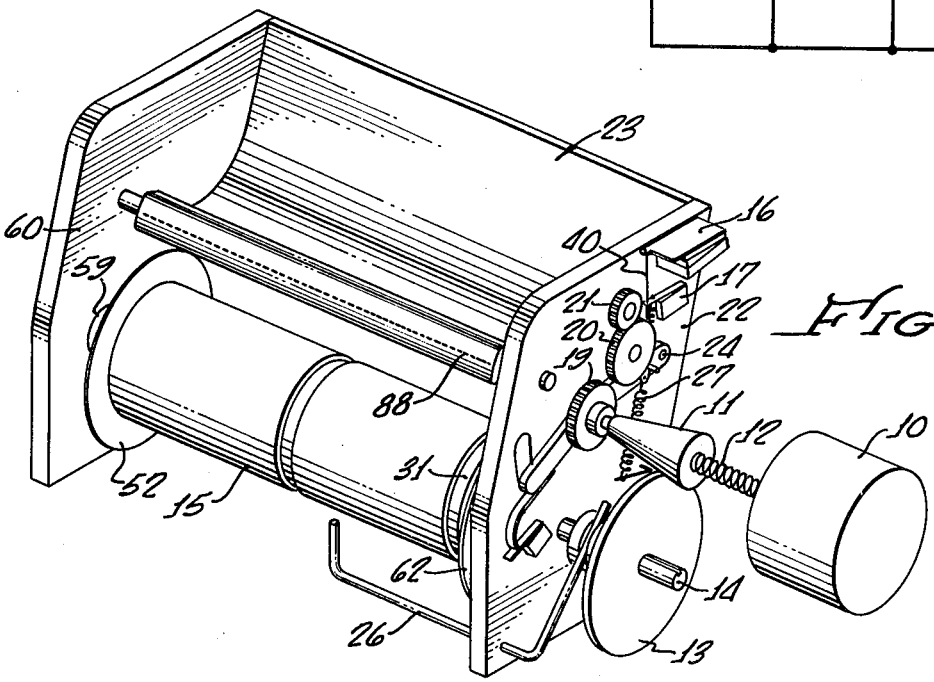
FIG. 2.
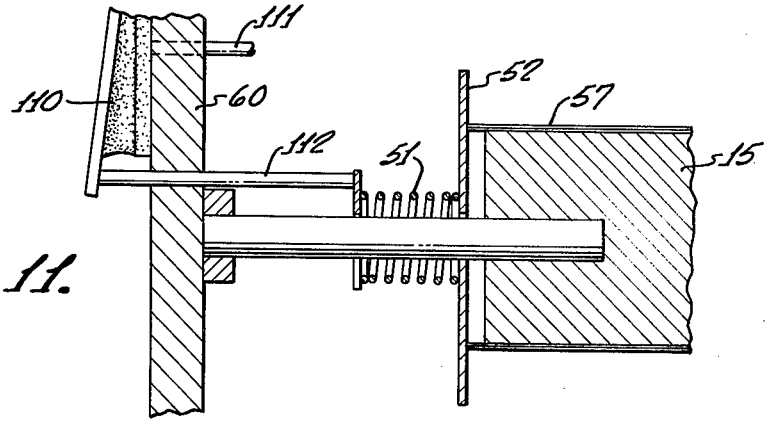
FIG. 11.

ELECTRO PNEUMATIC PLAYER PIANO

BACKGROUND OF THE INVENTION

From the early years of the Twentieth Century to the closing days of the Roaring Twenties, the pneumatic player piano was the most important medium of home entertainment. At a time when there were no radios, no television, and the closest thing to a hi-fi was a phonograph which was barely capable of reproducing music, the player piano was a truly marvelous instrument.

The conventional 88 note upright player piano utilizes vacuum as its motive power. The vacuum is created by "pumping" footpedals which operate suction bellows in the lower portion of the piano. The vacuum is channeled to (1) an air motor in the upper portion of the piano which functions to drive the paper roll over the tracker bar, and (2) a pneumatic stack which typically includes a common vacuum manifold and a separate diaphram, valve and bellows for each of the 88 notes. When a perforation in the paper roll passes over a hole in the tracker bar, air is admitted so as to deflect the associated diaphram (called a pouch) in the pneumatic stack. When a particular pouch is deflected, it lifts one of the 88 valves from its lower seat on the vacuum manifold to an upper seat which closes off the atmosphere and reduces the pressure in one of the 88 bellows. Each bellows is mechanically coupled to a different note which is struck by the collapsing bellows. After the perforation passes from the tracker bar the vacuum on both sides of the pouch is equalized by a small hole called the bleed. Atmospheric pressure on the valve causes it to return to its original position (lower seat on the vacuum manifold) thus removing the vacuum from the bellows.

Although the player piano, as a source of music, has been replaced by radio and modern Hi-Fidelity equipment, it is making a comeback as an entertainment center for family get togethers. When it comes to just plain fun and nostalgia the player piano is simply unequalled. An important reason for this lies in the fact that there is an interactive relationship between the human and the machine. The crowd can sing along with their favorite tunes, the pumper can vary the tempo as desired, or add expression by varying the pedalling force.

The traditional player action occupied a large volume within the piano case. It is therefore not possible to incorporate a conventional player action in a modern small case spinet piano. In addition to its bulkiness, many of the early player actions were difficult to pump - particularly for long periods. A further shortcoming of many early player piano mechanisms was due to the large vacuum reserve which was required for smooth operation of the air motors and pneumatics. The large reserve resulted in a long time constant for the vacuum system with a consequent decrease in the expression capabilities. Furthermore, from the standpoint of duplicating the traditional player piano actions, there is the additional factor posed by the tremendous increase in the cost of labor. What is actually desired is a high quality player piano action which can be inexpensively built and easily installed within the confines of a conventional spinet case without serious modification of the overall dimensions or appearance.

Accordingly, a primary object of the present invention is to provide an inexpensive player piano action which can be easily installed within the confines of a conventional modern spinet piano case without serious modification thereof.

A further object of one aspect of the present invention is to provide a pneumatic player piano having an electric roll drive.

A further object of one aspect of the present invention is to provide an arrangement for controlling an electric roll drive so as to simulate a conventional air motor drive.

A further object of one aspect of the present invention is to provide a minimum effort pneumatic player piano action.

A further object of one aspect of the present invention is to provide a pneumatic player piano which will rapidly respond to changes in pedal pressure.

A further object of one aspect of the present invention is to provide an improved pneumatic stack which can be largely fabricated using modern molding technology.

A further object of one aspect of the present invention is to provide a simple inexpensive pneumatic valve.

A further object of one aspect of the present invention is to provide an improved system for loading the take-up spool to effect roll tracking.

Other objects and advantages of the present invention will be obvious from the detailed description of a preferred embodiment given herein below.

SUMMARY OF THE INVENTION

The aforementioned objects are realized by the present invention comprising an electro-pneumatic player piano action. The system utilizes an electric motor roll drive that is switched "ON" or "OFF" by the closing of a sensing bellows which is responsive to the vacuum produced by pumping the foot pedals. In one embodiment, the motor is flexibly coupled to a conical shaft which rotates in frictional contact with a slideable disk. The disk is keyed to the shaft of the take-up spool to provide a continuously adjustable tempo. Rewind is accomplished by actuating a lever which operates a mechanical linkage to overide the sensing bellows and mechanically connect the output of the motor to the rewind spool through a direct gear arrangement. Roll tracking is effected using a spring biased wobble disk on the end of the take-up spool. The pneumatic stack incorporates a unique silicone rubber valve which greatly reduces the cost of assembly and eliminates the need for the spacers and adjustment that are normally required for player piano valves. The entire stack is formed in stratified portions, each strata being formable in a single molding operation. The resultant stack is a highly compact physical structure which is easily installable beneath a conventional 88 note keyboard. Alternative embodiments utilize a stack shut-off operated by the signals from the rewind and roll sensing elements to simulate air motor operation.

DESCRIPTION OF THE DRAWINGS

FIG. 1 shows a perspective view of how the player action would appear when incorporated in a conventional spinet piano.

FIG. 2 is a perspective view of the spool box and roll drive system in the "play" mode.

FIG. 11 shows an alternative embodiment of the tracker system.

FIG. 12 shows an alternative embodiment of a tempo control system.

DETAILED DESCRIPTION OF A PREFERRED EMBODIMENT

Figure 6:
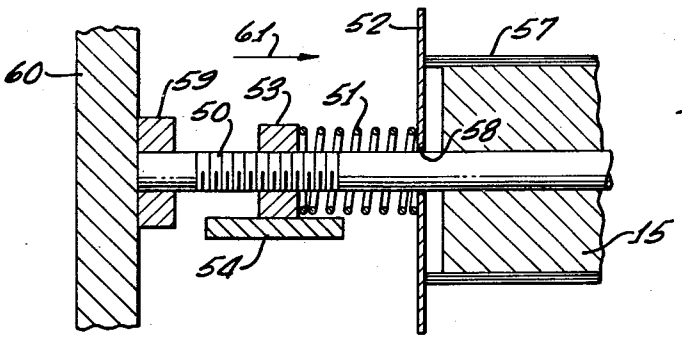
FIG. 6 is a front elevation of the mechanical tracker system.

Adverting to the drawings, and particularly FIGS. 2, 3, 4 and 5, a preferred embodiment of the roll drive aspect of the invention comprises an electric motor 10, a conical shaft 11 and rewind drive gear 19 (which are both flexibly coupled to the output shaft of motor 10 by a spring shaft 12), a rewind idler gear 20, a rewind spool gear 21, a rewind lever 18 (which is pivotally attached to side 22 of the spool box 23 by the journal pin 24), an overcenter toggle spring 25 (which functions to retain rewind lever 18 in one of two stable positions, a friction disc 13 slideably mounted to the keyed shaft 14 of the "take-up" spool 15, a sensing bellows 16 (which functions to operate micro switch 17 in accordance with the system vacuum as explained below), a tempo lever 26 (which may be moved so as to slide friction disc 13 on keyed shaft 14 to vary the speed of "take-up" spool 15 in proportion to the diameter of the conical shaft 11 at the point of contact), and a roll sensing control system comprising spring 27, spring 28, paper sensing finger 29, and rewind finger 30.

Figure 5:
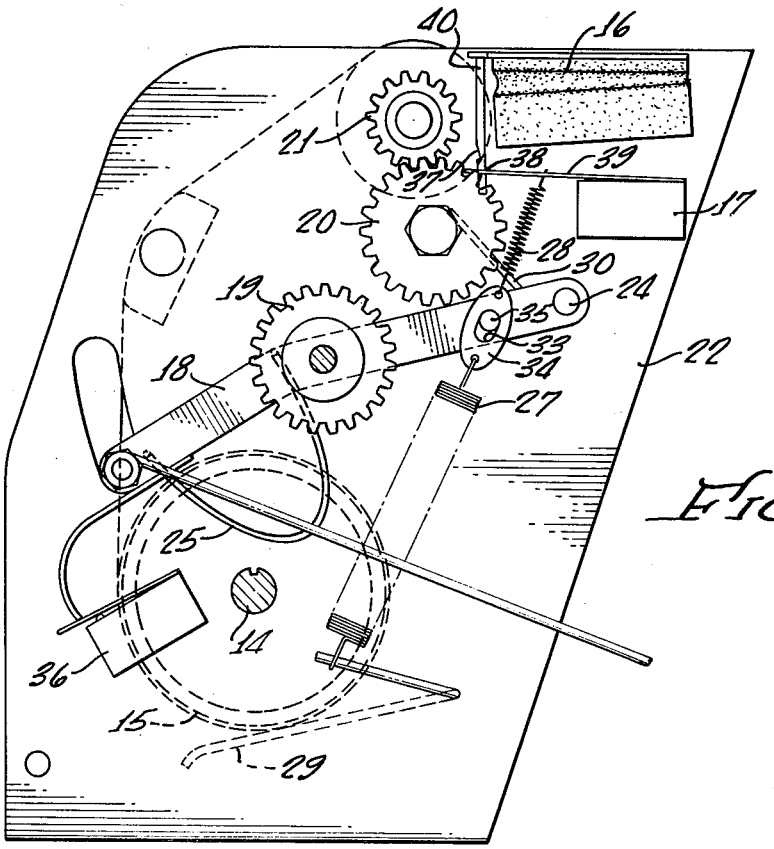
FIG. 5 is a side elevation showing the positional relationship of the roll drive elements in the playing mode.

In the "play" mode, rewind lever 18 will be "down" as shown in FIGS. 2 and 5 so as to disengage rewind drive gear 19 from rewind idler 20 and bring conical shaft 11 into contact with friction disc 13. A slight bias force to maintain lever 18 in this position is provided by toggle spring 25. The shift of the rewind lever 18 to the "play" position will not actuate switch 17 unless the paper sensing finger 29 is displaced from the circular groove 31 on take-up spool 15. After a roll is loaded and attached to spool 15, finger 29 will be displaced so as to pull spring 27 downwardly until the upper limit of the slot 33 in slideable coupling 34 contacts the pin 35. Pulling coupling 34 downwardly increases the tension in spring 28 and actuates switch 17 which energizes motor 10. Motor 10 is a synchronous motor which runs at constant angular velocity. The speed of spool 15 is thus dependent upon the position of friction disc 13 which is under the control of tempo lever 26. If the pedals have not been pumped, motor 10 will continue to rotate spool 15 at a speed determined by the ratio of the circumference of the friction disk 13 relative to the circumference of the conical shaft 11 at the point where the conical shaft 11 is in contact with the friction disk 13. Once the pedals are pumped the vacuum causes sensing bellows 16 to collapse (against the force of an internal bias spring) so that notch 37 drops below the hole 38 in arm 39. When the pumping is discontinued, the internal bias spring causes sensing bellows 16 to open - arm 39 being pulled upwardly by catch 37 against the force of spring 28 so as to open switch 17 and interrupt the power to motor 10. Subsequent pumping causes the motor to be again started (bellows 16 closes so that lever arm 39 can be pulled downwardly by spring 28) and so on. In summary the motor 10 runs automatically after a roll is loaded and lever 18 shifted to the "play" position — thus eliminating the pumping effort required to maintain a vacuum when the holes in the tracker bar are not sealed off by the presence of the roll. When pumping is initiated, the motor is brought under the control of the sensing bellows 16. Thereafter, the motor starts when the pedals are pumped, and stops when the pumping ceases — thus simulating an air motor.

Figure 3:
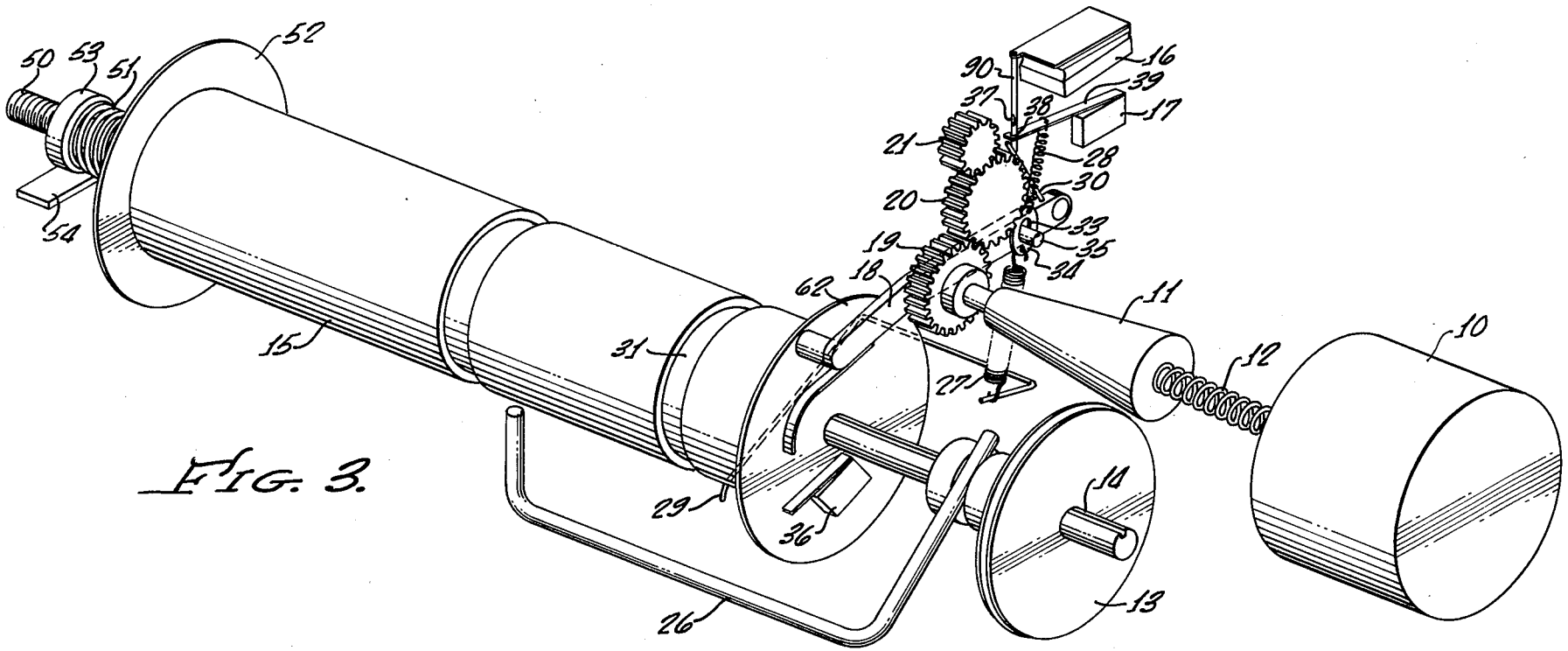
FIG. 3 shows the same elements in the rewind mode with the sides of the spool box omitted for clarity.
Figure 4:
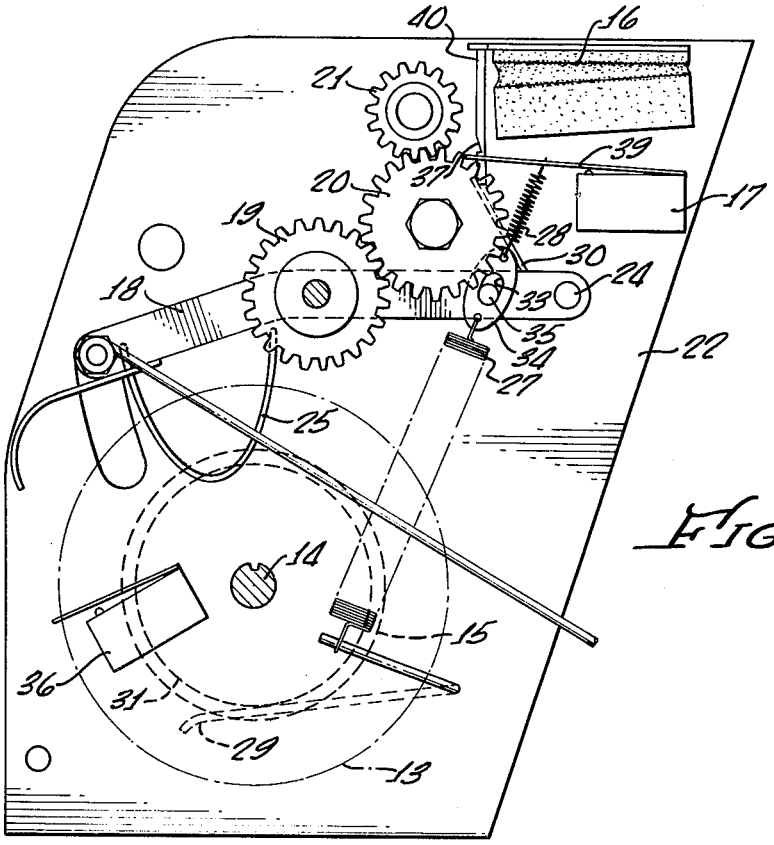
FIG. 4 is a side elevation showing the positional relationship of the roll drive elements in the rewind mode.

To rewind the roll, lever 18 is shifted to the "up" position thus engaging rewind gear 19 and idler gear 20 as shown in FIGS. 3 and 4. In the rewind mode toggle spring 25 functions to provide a slight bias force on lever 18 so as to maintain it in the "up" position. With the rewind lever 18 "up", rewind finger 30 will contact flexible stem 40 on sensing bellows 16 thus displacing flexible stem 40 so as to prevent notch 37 from engaging the lever arm 39 of switch 17. Operation of motor 10 is thus independent of the system vacuum during rewind operation. As long as the paper sensing finger 29 is displaced from its recessed position in groove 31, the motor 10 will continue to drive rewind spool gear 21 through rewind gear 19 and idler 20 — the mechanical linkage for actuation of motor 10 being the same as that described above namely, spring 27, slide coupling 35 and spring 28. After the paper leaves take-up spool 15, the paper sensing finger 29 drops into groove 31. This reduces the tension in springs 27 and 28 and deactuates switch 17 — the position of the elements being as shown in FIG. 4. In summary, the starting and stopping of the rewind operation are carried out automatically upon shifting the lever 18 to the "up" position.

Referring now to FIG. 6, the roll tracking aspect of the invention comprises a "left-hand" threaded shaft 50 and circular nut 53, a wobble disk 52, a friction surface 54 and a spring 51. The threaded shaft 50 is attached to, and functions as the left side axle for "take-up" spool 15. The free end of shaft 50 is journaled in a bearing 59 which is attached to the left side 60 of spool box 23. The inside diameter of center hole 58 in disk 52 is slightly larger than the diameter of shaft 50 so as to permit the plane of disk 52 to be other than at right angles to the axis of shaft 50. The bias force on the wobble disk 52 is determined by the deflection of compression spring 51. As the spool 15 rotates, nut 53 moves to the right in the direction of arrow 61 (so as to compress spring 51) until the spring force equals the frictional force between the surface 54 and the nut 53. The plane of disk 52 thus wobbles about the axis of shaft 50 in response to changes in the width of the paper 57. The regulated bias provided by the friction nut 53 and spring 51 thus causes wobble disk 52 to gently urge the roll to register against the surface of fixed disk 62 as it is taken up on spool 15.

The system shown in FIG. 6 has one disadvantage in that the wobble disk will be preloaded if the spool 15 is turned before the roll is attached. An alternative embodiment for obviating this shortcoming is shown in FIG. 11. The bellows 110 is mounted on the left side 60 of the spool box 23 and connected to the vacuum source by a small line 111. When vacuum is created by pumping, the bellows 110 slowly collapses causing rod 112 to compress spring 51 so as to increase the bias on wobble disk 52. As soon as the vacuum is no longer applied, bellows 110 opens, removing the bias from wobble disk 52.

The improved pneumatic aspects of the invention are illustrated in FIGS. 7, 8, 9 and 10. The stack is formed in tiers which comprise an underplate 70, a pouch frame 71, a pouch leaf 72, a vacuum manifold 73, a lower valve seat and guide plate 74, a valve chamber frame 75, an upper valve seat plate 76, a filter frame 77, and filter cloth 78. Each of the 88 valve assemblies comprises a stem unit 80 and face disk 81.

The structural tiers of the stack (71, 73, 75 and 77) are preferrably made of a highly stable plastic such as polyvinyl chloride which will facilitate fabrication of these tier elements in a single molding operation. The upper and lower valve plates may be made of aluminum or plastic — the entire plates being formable in a single stamping operation. The pouch material can be a durable plastic fabric sych as .003 polyurethane membrane. In contrast to prior art pneumatic stacks, the present invention does not require a great deal of construction time since the 88 individual valve boxes, valve guides and pouches are created at one time - i.e., when the tiers of the stack are assembled together.

The valve disk 81 is preferrably made of silicone rubber. The disk 81 is formed by a punching operation. It was discovered that the natural result of punching a hole in a sheet of silicone rubber is to create an aperture having a bulging wall. In the present invention, this discovery is utilized to couple the disk to the stem - the latter being formed so as to have an accordant recess 83 over which the flexible silicone bulge 82 can be easily fitted. The stem 80 is preferrably formed of a plastic such as polypropylene using conventional injection molding technology. The present valve assembly thus eliminates the need for the spacers and threaded shaft adjustments which were used on prior valve assemblies in order to allow the valve disks to wobble on the valve shaft to accommodate for misalignments. A second important feature of the present valve over prior art valves (which consist of a rigid fibre backing covered with a soft leather) lies in the fact that material is sufficiently rigid — and sufficiently soft - to satisfy both requirements. A third advantage gained by the silicone rubber valve face lies in the fact that it eliminates the problem of minor valve leaks which result from the tendency of foreign particles to adhere to the surface of conventional leather valves.

Figure 7:
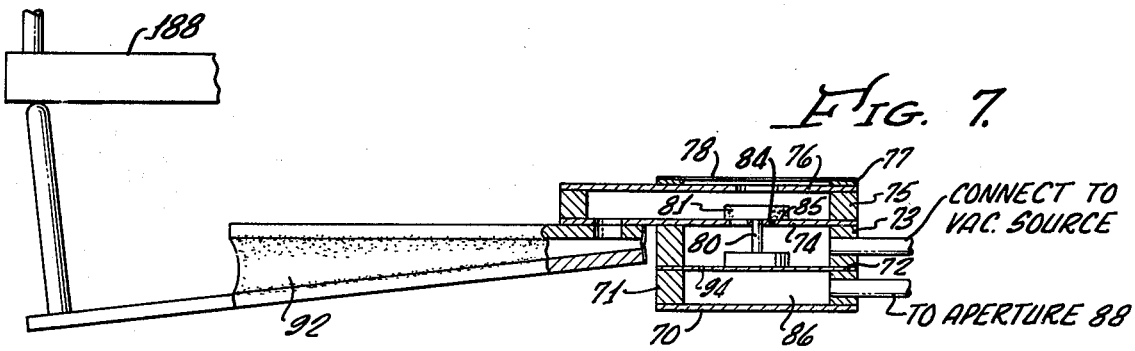
FIG. 7 is a cross-sectional view of the pneumatic stack showing the position of the elements before the note is struck.
Figure 8:
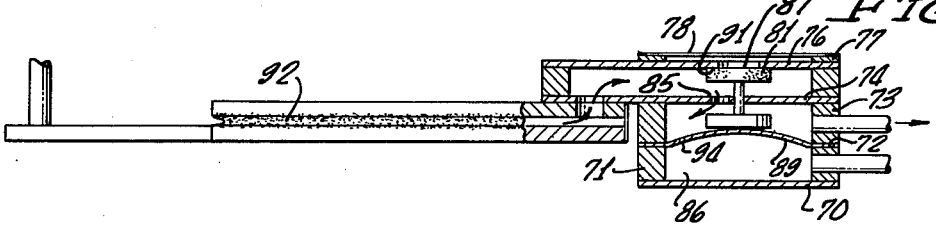
FIG. 8 is a cross-sectional view of the same elements showing the position of the elements when the note is struck.

The operation of the pneumatic stack is identical to prior art systems. As shown in FIG. 7, the lower valve face 84 normally rests against the lower seat opening 85 of the plate 74 so as to close off the vacuum manifold formed by leaf 72, frame 73 and plate 74. When a roll perforation coincides with the tracker bar aperture (e.g., aperture 88), air is admitted to the pouch chamber 86 (formed by plate 70, leaf 72 and the walls of frame 71) causing the pouch 89 (a segment of leaf 72) to deflect upwardly until the top face 87 contacts the upper seat 91 of plate 76 as shown in FIG. 8. The air within the bellows 92 is thus drawn into the vacuum source through the valve opening 85 in plate 74. The closing of the bellows strikes the note by pushing upwardly on the back of the key 188. After the perforation passes, aperture 88 is closed off to the atmosphere - allowing vacuum to build up within the chamber 86 through a bleed hole 94 in the pouch 89. The external pressure on face 87 returns the valve to the position shown in FIG. 7.

The pneumatic stack is preferably mounted beneath the keyboard - each bellows being spaced to contact a particular key upon closure. Properly mounted, the stack is unobservable when viewed from any position other than beneath the piano. Other than the minor surgery required for installation of the spool box, the piano case need not be modified. The complete action, when installed, will appear as shown in FIG. 1.

Figure 13:
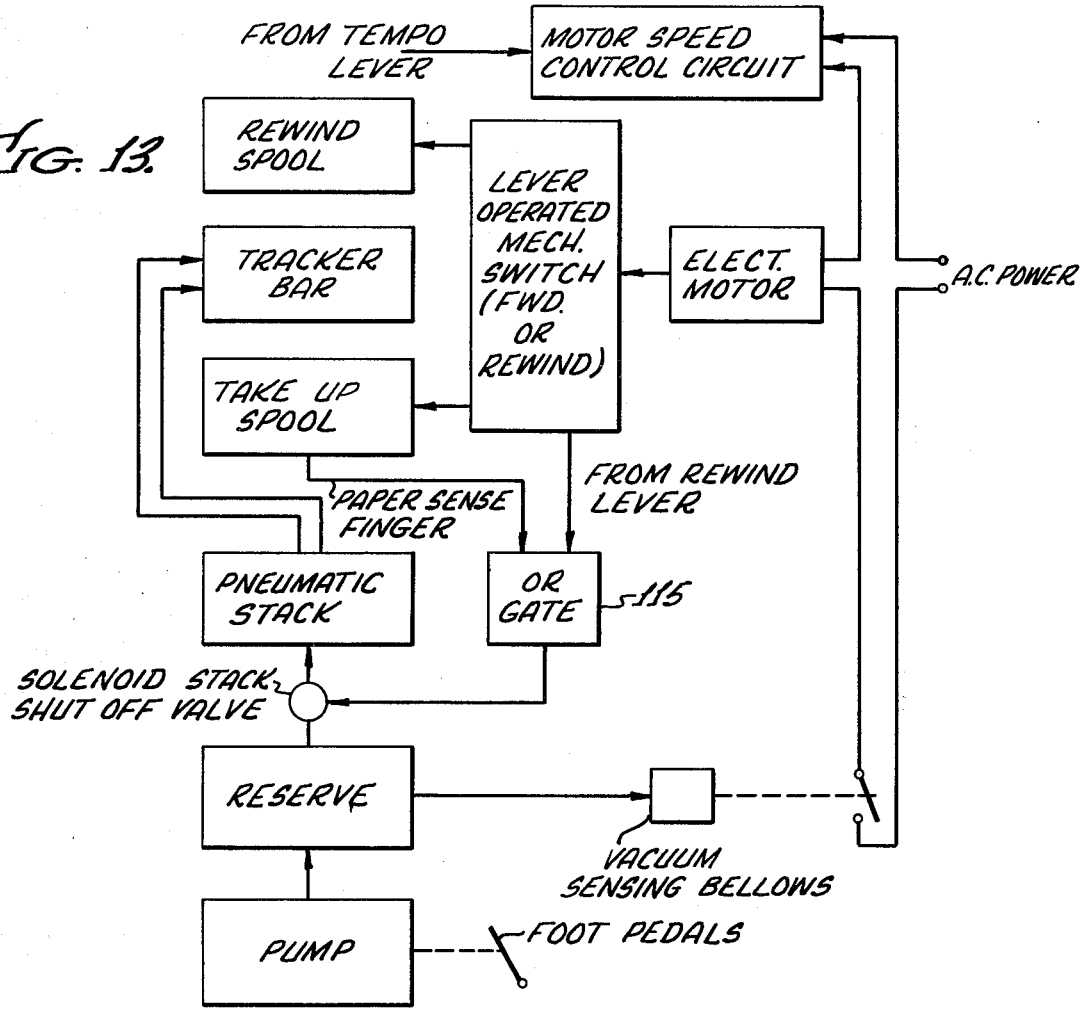
FIG. 13 shows a block diagram of an electro-pneumatic system which will simulate an all pneumatic player piano.
Figures 9, 10:
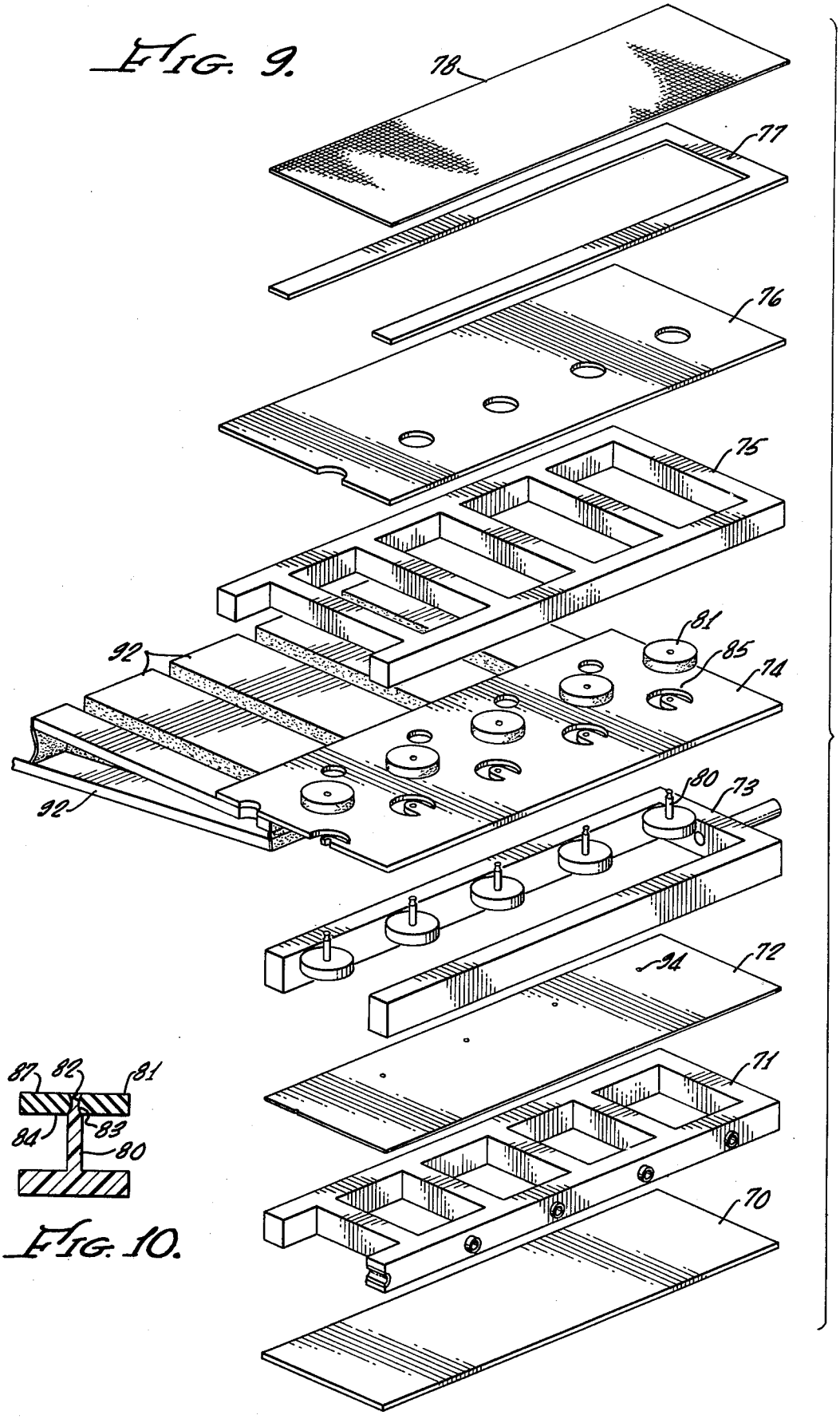
FIG. 9 is an exploded perspective view of the pneumatic stack.
FIG. 10 shows a cross-section of the valve assembly.

Although the present invention has been shown and described with reference to a preferred embodiment, it will be evident that there are many alternatives. One could, for example, vary the tempo by using a universal motor and motor speed control circuit like that shown in FIG. 12. Another modification would be the complete simulation of an all pneumatic player action. This can be most easily accomplished by including a stack shut-off valve operated by lever 18 in the rewind mode and eliminating the elements associated with engaging and disengaging switch 17 from bellows 16. The motor can then be operated directly from switch 17 whenever bellows 16 collapses. If the mechanical signal generated by the absence of the roll on spool 15 is also used to operate the stack shut-off valve, the piano can be easily pedalled as the roll is initially taken up on spool 15. A block diagram of such a system is shown in FIG. 13, wherein the "OR" gate 115 is preferrably two electric switches, one of which is operated by the rewind lever and the other being operated by the movement of the paper sensing finger. Conversely the inclusion of an air pump and switch 36 operated by lever 18 in the play mode will render the system totally electric.

It will thus be realized that the teachings of the invention are much broader than the exemplary embodiments disclosed herein, and that the basic concepts of the invention have additional applications when combined with one another and with various conventional player piano actions. Accordingly, although preferred embodiments have been shown and described, it will be understood that the invention is not limited thereto and that numerous changes, modifications and substitutions may be made without departing from the spirit of the invention.

I claim:

1. A player piano action comprising:

an electric motor having an output shaft;

a spool box including a tracker bar and take-up spool;

means for coupling the output shaft of said electric motor to said "take-up" spool so as to cause said take-up spool to rotate when said electric motor is actuated;

pedal means for producing a vacuum;

a pneumatic stack, said pneumatic stack including a valve for each note of the piano to be operated by the player piano action and wherein said pneumatic stack comprises:

a plurality of tiers and wherein a first tier includes:

a pouch frame having a plurality of uniform openings;

a sheet of flexible non-porous material positioned to cover a plurality of openings on one side of said frame so as to form a plurality of pouch diaphrams from a single sheet of material;

conduit means for channeling the vacuum produced by said pedal means to said pneumatic stack;

sensing means for detecting the presence of vacuum produced by said pedal means;

switch means responsively connected to said sensing means for operating said electric motor in response to the vacuum produced by said pedal means;

a valve chamber frame positioned in contact with said lower valve plate, said valve chamber frame having a plurality of openings each spaced to relate to a particular valve opening and pouch frame opening when said valve chamber frame is positioned adjacent to said lower valve seat plate;

an upper valve seat plate having a plurality of valve openings each spaced to relate to a particular lower valve seat opening when said upper valve seat plate is positioned to cover the openings in said valve chamber frame;

a filter sheet;

means for positioning said filter sheet so as to cover the openings in said upper valve seat;

a plurality of bellows, each of said bellows being attached to said valve chamber frame and each having an opening communicating with one of the chambers formed by the upper and lower valve plates and the walls of the openings in said valve chamber frame.

2. A player piano action comprising:

an electric motor having an output shaft;

a spool box including a tracker bar and take-up spool;

means for coupling the output shaft of said electric motor to said "take-up" spool so as to cause said take-up spool to rotate when said electric motor is actuated;

pedal means for producing a vacuum;

a pneumatic stack, said pneumatic stack including a valve for each note of the piano to be operated by the player piano action, and wherein each of said note valves comprise:

a pliable disk having a bulging wall aperture;

a stem having an annular recess adapted to accommodate the bulging wall of said aperture, said pliable disk to be fitted on said shaft so that the annular recess accommodates the bulge in the wall of the aperture in said pliable disk;

conduit means for channeling the vacuum produced by said pedal means to said pneumatic stack;

sensing means for detecting the presence of vacuum produced by said pedal means;

switch means responsively connected to said sensing means for operating said electric motor in response to the vacuum produced by said pedal means;

a rewind lever having a first "play" position and a second "rewind" position;

means for detecting the presence of the music roll on said "take-up" spool;

a stack shut-off valve;

means for operating said stack shut-off valve from said roll detector means and;

means for operating said stack shut-off valve from said rewind lever.

3. A pneumatic stack for a player piano comprising:

a pouch frame having a plurality of uniform openings;

a sheet of flexible non-porous material positioned to cover the openings of one side of said frame;

a rigid plate positioned to cover the rectangular openings on the other side of said pouch frame;

a manifold frame having an external dimension commensurate with the external dimension of said pouch frame, said manifold frame having a single opening of a size sufficient to encompass all of the openings in said pouch frame;

means for positioning said manifold frame in contact with said sheet of flexible non-porous material;

a lower valve seat plate having a plurality of valve openings each spaced to relate to a particular opening in said pouch frame when said valve seat plate is positioned to cover the opening in said manifold frame;

a valve chamber frame positioned in contact with said lower valve plate, said valve chamber frame having a plurality of openings each spaced to relate to a particular valve opening and pouch frame opening when said valve chamber frame is positioned adjacent to said lower valve seat plate;

an upper valve seat plate having a plurality of valve openings each spaced to relate to a particular lower valve seat opening when said upper valve seat plate is positioned to cover the openings in said valve chamber frame;

a filter sheet;

means for positioning said filter sheet so as to cover the openings in said upper valve seat;

a plurality of bellows, each of said bellows being attached to said valve chamber frame and each having an opening communicating with one of the chambers formed by said upper and lower valve seat plates and the walls of the openings in said valve chamber frame.

* * * * *